United States Patent [19]

Kohl

[11] Patent Number: 4,691,460

[45] Date of Patent: Sep. 8, 1987

[54] DECORATIVE PLAQUE WITH REPLACEABLE DECORATIVE ELEMENT

[76] Inventor: Jerry Kohl, 800 Holladay Rd., Pasadena, Calif. 91106

[21] Appl. No.: 774,027

[22] Filed: Sep. 9, 1985

[51] Int. Cl.[4] ..... G09F 7/02

[52] U.S. Cl. ..... 40/618; 40/21 C; 2/338

[58] Field of Search ..... 40/618, 1.6, 21 C, 586; 2/338; 24/163 K, 163 FC

[56] References Cited

U.S. PATENT DOCUMENTS

| | | | |
|---|---|---|---|
| 642,803 | 2/1900 | Paige | 40/618 |
| 1,098,086 | 5/1914 | Blum et al. | 40/21 C |
| 1,258,146 | 3/1918 | Russell | 40/618 |
| 1,438,550 | 12/1922 | Pollak | 40/618 |
| 1,581,822 | 4/1926 | Warden | 40/618 |
| 1,635,077 | 7/1927 | Erskine | 40/618 |
| 1,994,686 | 3/1935 | Chernow | 40/618 |
| 2,282,606 | 5/1942 | Placco | 40/618 |
| 2,597,155 | 5/1952 | Marien | 24/191 |
| 2,967,366 | 1/1961 | Colbert | 40/618 |
| 3,864,791 | 2/1975 | Bishop | 24/163 |
| 3,969,836 | 7/1976 | DuBois | 40/21 C |
| 4,052,773 | 10/1977 | Nesbitt | 24/163 K |
| 4,340,976 | 7/1982 | Wright | 40/618 |
| 4,502,188 | 3/1985 | Kohli | 24/163 K |
| 4,521,923 | 6/1985 | Mackey | 40/618 |

*Primary Examiner*—John J. Wilson
*Assistant Examiner*—Cary E. Stone
*Attorney, Agent, or Firm*—Sheldon & Mak

[57] ABSTRACT

A decorative plaque with replaceable decorative elements is suitable for use with belts. The plaque has a frame having a front opening for the viewing of replaceable decorative elements, such as alphabets and letters, set on a decorative fabric. The frame and the decorative elements have interlocking serrations for preventing movement of the decorative elements along the width of the opening.

16 Claims, 5 Drawing Figures

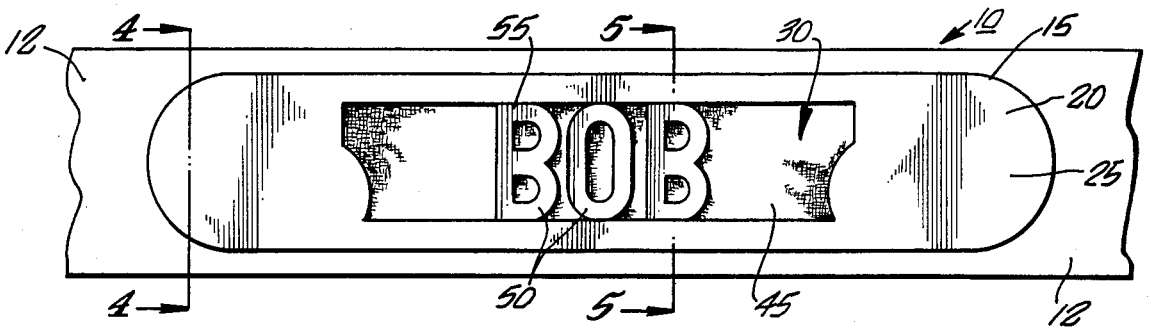
FIG. 1
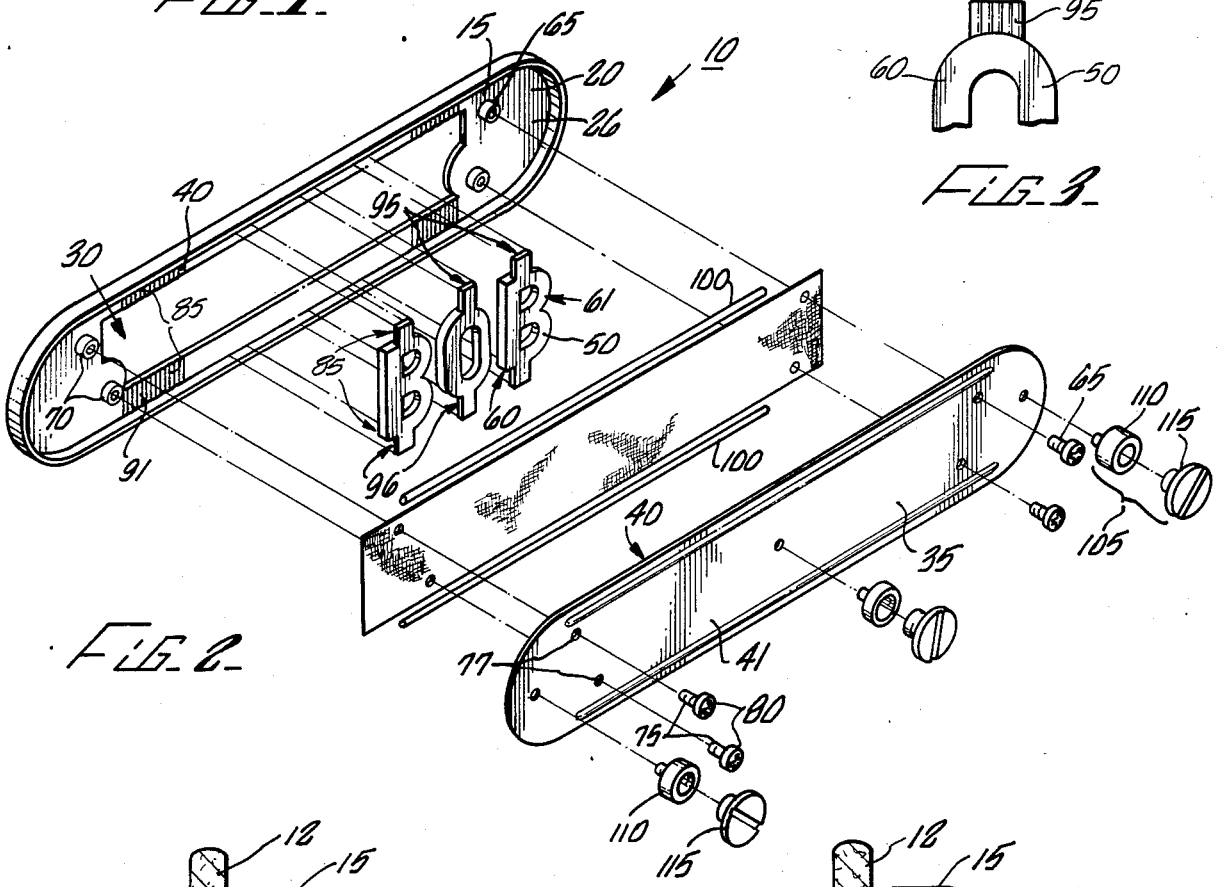
FIG. 2
FIG. 3
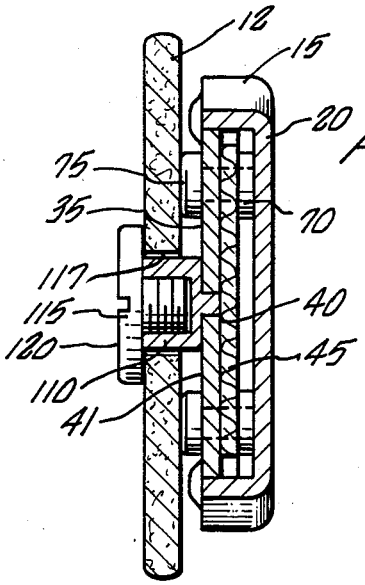
FIG. 4
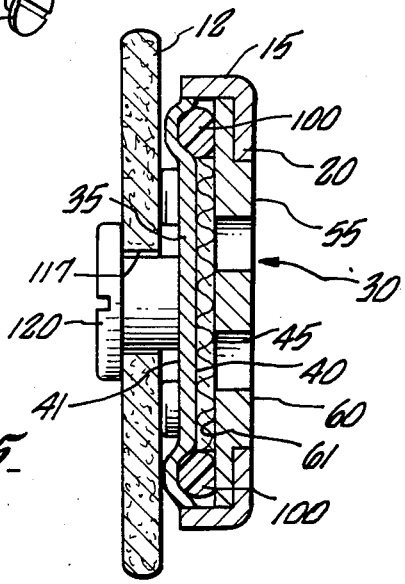
FIG. 5

DECORATIVE PLAQUE WITH REPLACEABLE DECORATIVE ELEMENT

BACKGROUND

This invention relates to a decorative plaque with replaceable decorative elements.

Decorative belt plates are known, especially those for use with Western style belts. These metal plates are usually hand made and can bear intricate surface designs and have the name of the owner or monograms placed thereon. The plates are usually silver plated, or are formed of silver. The belt plates serve to both decorate and personalize the belt of the owner. Belt plates are generally attached to the belt by the use of screws, which pass through holes in the belt and are threadingly engaged to screw nuts affixed to the back of the belt plate.

One serious shortcoming of existing belt plates is their cost. Because personalization (use of name) is usually desired, the service of a craftsman such as a silversmith is required. Moreover, if the owner wishes to change the information on the plate, he will need to replace the entire plate.

What is needed is an inexpensive belt plate which can easily be personalized by unskilled personnel, where the plate has a "hand-made" appearance.

SUMMARY

A decorative plaque of the present invention satisfy this need. It comprises a frame having an elongated cover plate with an elongated opening therethrough. The cover plate has a decorative front face and a back face.

The frame also comprises a backing plate similar in shape to the cover plate and adapted for removable attachment to the cover plate, the backing plate having a front face and a back face. Preferably a decorative fabric is affixed to the front face of the backing plate.

The plaque also comprises at least one replaceable decorative element sized and adapted for removable insertion between the cover plate and the backing plate so that at least an exposed portion of the decorative element shows through the elongated opening of the cover plate. Each decorative element is no wider than the width of the opening. The decorative element has a front and a back face.

There are also means for removably affixing the backing plate to the cover plate so that the decorative element is firmly held in place, and means for removably attaching the decorative plaque to a belt.

The frame and the decorative element have interlocking engaging means for preventing the decorative element from moving along the length of the elongated opening. Preferably the interlocking engaging means comprise at least one row of serrations in the frame extending along substantially the entire length of the elongated opening, and at least one row of serrations on the decorative element capable of interlockingly engaging the serrations in the frame. Preferably the serrations are uniformly sized and evenly spaced.

Preferably the exposed portion of the decorative element is substantially flush with the front surface of the cover plate. The decorative element can preferably be a letter of the alphabet, or other decorative designs.

DRAWINGS

These and other features, aspects, and advantages of the present invention will become better understood with reference to the following description, appended claims, and accompanying drawings where:

FIG. 1 is a front perspective view of a decorative plaque according to the present invention shown attached to a belt;

FIG. 2 is a rear exploded view of the plaque of FIG. 1 without the belt;

FIG. 3 is a front perspective view of a portion of a decorative element of the plaque of FIG. 1;

FIG. 4 is a cross sectional view taken along line 4—4 of FIG. 1; and FIG. 5 is a cross sectional view taken along line 5-5 of FIG. 1.

DESCRIPTION

With reference to FIG. 1, a decorative plaque 10 embodying features of the present invention is shown attached to a belt 12. Referring to FIGS. 1 and 2, the plaque 10 comprises a frame 15 having an elongated cover plate 20, which has a decorative front face 25 and a back face 26. The cover plate 20 has an elongated opening 30 therethrough. The frame 15 further comprises a backing plate 35 similar in shape to the cover plate 20. The backing plate 35 has a front face 40 and a back face 41. Preferably a decorative fabric 45 is affixed to the front face 40 of the backing plate 35, the fabric 45 showing through the elongated opening 30 of the cover plate 20.

The plaque also comprises at least one decorative element 50 sized and adapted for removable insertion beween the cover plate 20 and the backing plate 35, such that at least an exposed portion 55 of the decorative element 50 shows through the elongated opening 30 of the cover plate 20. Preferably the exposed portion 55 is substantially flush with the decorative front face 25 of the cover plate 20. Each decorative element 50 is no wider than the length of the elongaged opening 30. Each decorative element 50 has a front face 60 and a back face 61. Typically the decorative element 50 is in the shape of a letter of an alphabet, or other decorative designs, such as a star, an animal such as a horse, a horoscopic sign, etc.

There are affixing means 65 for removably affixing the backing plate 35 to the cover plate 20 so that the decorative element 50 is firmly held in place therebetween. Preferably the affixing means comprise screw nuts 70 affixed to the back face 26 of the cover plate 20, and screws 75 passing through holes 77 in the backing plate 35. Each screw 75 has a head 80 too large to pass through the hole 77 in the backing plate 35, and is therefore capable of holding the backing plate 35 firmly against the cover plate 20.

The frame 15 and the decorative element 50 have interlocking engaging means 85 for preventing the decorative element 50 from moving along the length of the elongated opening 30.

Preferably the engaging means comprise at least one row of serrations in the frame 15 extending along substantially the entire length of the elongated opening 30, and at least one row of serrations on the decorative element capable of interlockingly engaging the serrations in the frame 15. Preferably the serrations are uniformly sized and evenly spaced. For example, the serrations can be spaced about 1/32 inch apart. The serrations can be rounded or angular.

FIG. 2 shows a version of the plaque having two rows of serrations, 90 and 91, being above and below the elongated opening 30, on the back face 26 of the cover plate 20. There are corresponding rows of serrations 95 and 96 on the front face 60 of each decorative element 50. When the decorative element 50 is placed between the cover plate 20 and the backing plate 35, and is pressed against the cover plate 20 by the backing plate 35, the serrations 90 and 95, and 91 and 96, respectively, will interlockingly engage each other to prevent the movement of the decorative element 50 along the length of the elongated opening 30.

Preferably the frame 15 further comprises at least one strip of resilient material 100 affixed to the frame 15. The strip 100 is preferably formed of rubber or plastic. The strip 100 is sized and located such that, when the backing plate 35 is affixed to the cover plate 20, the strip 100 runs substantially along the entire length of, and proximate to, one of the rows of serrations 90 and 91 on the frame 15, without the strip 100 showing through the elongated opening 30 in the cover plate 20. The strip 100 is capable of resiliently and firmly holding the decorative elements against the frame 15. For example, when the two rows of serrations 90 and 91 are on the back face 26 of the cover plate 20, there are preferably two strips 100 affixed to the front face 40 of the backing plate 35, corresponding in position to the two rows of serrations 90 and 91.

Alternatively, the rows of serrations 90 and 91 on the frame 15 could be on the front face 40 of the backing plate 35; the rows of serrations 95 and 96 on the decorative element 50 could be on the back face 61 of the decorative element 50; and the strips 100 could be on the back face 26 of the cover plate 20.

Preferably there are attachment means 105 for removably attaching the decorative plaque 10 to a belt 12. The attachment means 105 can comprise backing screw nuts 110 affixed to the back face 41 of the backing plate 35, and backing screws 115 passing through holes 117 in the belt 12, and threadingly engaging the backing screw nuts 110 on the backing plate 35. The backing screw 115 has a head 120 too large to pass through the hole 117 in the belt 12, and is therefore capable of holding the belt 12 firmly against the backing plate 35.

No special training is required to assemble or dismantle the plaque 10 from or to its component parts. A small screwdriver (not shown) is the only tool needed. The decorative element 50 can be changed quickly at will thereby changing the information displayed on the plaque. The assembler simply selects the desired decorative elements, places them into frame members so that the serrations on the elements and the frame engage, then screws the backing plate down so that the decorative elements are held firmly against the frame member. The evenly spaced serrations ensure even spacing of the decorative elements, and serve to hold the decorative elements in place until the backing plate is installed. The plaque is then ready for attachment to a belt. The background appearance can also be changed by using a backing plate having a different decorative fabric attached thereto. By purchasing several backing plates, each with a distinctive decorative fabric attached thereto, and keeping on hand a reasonable stock of decorative elements, the owner of the decorative plaque according to the present invention can create a plaque with many different looks.

Manufacture of the decorative plaque according to the present invention is easy and economical. To maintain a "handmade" look, it is preferable that at least the frame 15 and the decorative element 50 be formed of metal, such as silver, or silver plated brass, etc. Preferably the cover plate 20 should have attractive designs thereon. Another alternative is to form any or all the frame 15 and the decorative element out of silver plated plastic.

Although the present invention has been described in considerable detail with reference to certain preferred versions thereof, other versions are possible. For example, the interlocking engaging means 85 need not be rows of serrations, but could be any other means for preventing lateral movement of the decorative elements. The interlocking engaging means could comprise friction-providing rubber strips on the frame 15 and the decorative element 50. Alternatively, the frame 15 and the decorative element 50 can have interlocking strips of small hooks, such as the attachment means sold under the trademark "Velcro". Therefore, the spirit and scope of the appended claims should not necessarily be limited to the description of the preferred versions contained herein.

What is claimed is:

1. An elongated decorative plaque suitable for mounting on belts comprising:

(a) a frame comprising:

(i) an elongated cover plate having an elongated opening therethrough, the cover plate having a decorative front face and a back face; and (ii) a backing place similar in shape to the cover plate and adapted for removable attachment to the cover plate, the backing plate having a front face and a back face;

(b) at least one replaceable decorative element sized and adapted for removable insertion between the cover plate and the backing plate such that at least an exposed portion of the decorative element shows through the opening of the cover plate, each decorative element being no wider than the length of the elongated opening, the decorative element having a front face and a back face;

(c) means for removably affixing the backing plate to the cover plate so that the decorative element is firmly held in place therebetween, the affixing means comprising (i) screw nuts affixed to the back face of the cover plate; and (ii) screws passing through the backing plate and threadingly engageable with the screw nuts, the screws each having a head too large to pass through the backing plate and therefore capable of holding the backing plate firmly against the cover plate;

the frame and the decorative element having interlocking engaging means for preventing the decorative element from moving along the length of the elongated opening.

2. The plaque of claim 1 wherein the interlocking engaging means comprise interlocking rows of serrations.

3. The plaque of claim 2 wherein the engaging means comprises:

(a) at least one row of serrations in the frame extending along substantially the entire length of the opening; and (b) at least one row of serrations on the decorative element capable of interlockingly engaging the serrations in the frame.

4. The plaque of claim 3 wherein the serrations are uniformly sized and evenly spaced.

5. The plaque of claim 3 wherein the serrations on the frame are on the back face of the cover plate, and the serrations on the decorative element are on its front face.

6. The plaque of claim 3 wherein the serrations on the frame are on the front face of the backing plate, and the serrations on the decorative element are on its back face.

7. The plaque of claim 3 wherein there are two rows of serrations on the frame, one above and one below the opening, and two corresponding rows of serrations on the decorative element.

8. The plaque of claim 3 wherein the frame further comprises at least one strip of resilient material affixed to the frame, sized and located such that, when the backing plate is affixed to the cover plate, the strip runs substantially along the entire length of, and proximate to, one of the rows of serrations on the frame, without the strip showing through the opening in the cover plate, the strip being capable of resiliently and firmly holding the decorative element against the frame.

9. The plaque of claim 8 wherein the serrations on the frame are on the back face of the cover plate, the serrations on the decorative element are on its front face, and the strip of resilient material is on the front face of the backing plate.

10. The plaque of claim 8 wherein the serrations on the frame are on the front face of the backing plate, the serrations on the decorative element are on its back face, and the strip of resilient material are on the back face of the cover plate.

11. The plaque of claim 8 wherein the strips of resilient material are formed of rubber.

12. The plaque of claim 1 further comprising a decorative fabric affixed to the front face of the backing plate, the fabric showing through the opening in the cover plate.

13. The plaque of claim 1 wherein the exposed portion of the decorative element is substantially flush with the front face of the cover plate.

14. An elongated decorative plaque suitable for mounting on belts comprising:

(a) a frame comprising:

(i) an elongated cover plate having an elongated opening therethrough, the cover plate having a decorative front face and a back face, the back face of the cover plate having two rows of uniformly sized and evenly spaced serrations, one above and one below the opening, each row of serrations extending along substantially the entire length of the opening; and (ii) a backing plate similar in shape to the cover plate and adapted for removable attachment to the cover plate, the backing plate having a front face and a back face, the backing plate further comprising a decorative fabric affixed to the front face thereof, the fabric showing through the opening in the cover plate, the backing plate also comprising two strips of resilient material affixed to the front face thereof, the strips being sized and located such that, when the backing plate is affixed to the cover plate, each strip runs substantially along the entire length of, and proximate to, one of two rows of serrations on the cover plate, without the strips showing through the opening in the cover plate;

(b) at least one replaceable decorative element sized and adapted for removable insertion between the cover plate and the backing plate such that at least an exposed portion of the decorative element shows through the opening of the cover plate, the exposed portion being substantially flush with the front face of the cover plate, each decorative element being no wider than the length of the elongated opening, the decorative element having a front face and a back face, the decorative element having two rows of uniformly sized and evenly spaced serrations on its front face, the serrations on the decorative element being sized and located such that they are capable of intelockingly engaging the serrations on the cover plate to prevent movement of the decorative element along the length of the elongated opening;

(c) means for removably affixing the backing plate to the cover plate so that the decorative element is firmly held in place therebetween, the affixing means comprising:

(i) screw nuts affixed to the back face of the cover plate; and (ii) screws passing through the backing plate and threadingly engageable with the screw nuts, the head of the screws being too large to pass through the backing plate and therefore capable of holding the backing plate firmly against the cover plate;

the decorative plaque being assembled with the decorative element placed between the cover plate and the backing plate, with the serrations on the decorative element and the cover plate interlockingly engaging each other, and with the screws tightened such that the backing plate is held firmly against the cover plate, and such that the strips of resilient material resiliently and firmly hold the decorative element against the cover plate.

15. A belt and decorative plaque combination, comprising:

(a) a belt;

(b) an elongated decorative plaque suitable for mounting on the belt comprising:

(i) a frame comprising:

(A) an elongated cover plate having an elongated opening therethrough, the cover plate having a decorative front face and a back face; and (B) a backing plate similar in shape to the cover plate and adapted for removable attachment to the cover plate, the backing plate having a front face and a back face;

(ii) at least one replaceable decorative element sized and adapted for removable insertion between the cover plate and the backing plate such that at least an exposed portion of the decorative element shows through the opening of the cover plate, each decorative element being now wider than the length of the elongated opening, the decorative element having a front face and a back face; and (iii) means for removably affixing the backing plate to the cover plate so that the decorative element is firmly held in place therebetween;

the frame and the decorative element having interlocking engaging means for preventing the decorative element from moving along the length of the elongated opening; and (c) means for removably attaching the plaque to the belt, the attaching means comprising:

(i) backing screw nuts affixed to the back face of the backing plate; and (ii) backing screws passing through the belt and threadingly engaging the backing screw nuts on the backing plate, the backing screws each having a head too large to pass through the belt and therefore capable of holding the belt firmly against the backing plate.

16. A method for mounting an elongated decorative plaque on a belt, comprising the steps of:

(a) selecting a kit of parts comprising:

(i) a frame comprising:

(A) an elongated cover plate having an elongated opening therethrough, the cover plate having a decorative front face and a back face; and (B) a backing plate similar in shape to the cover plate and adapted for removable attachment to the cover plate, the backing plate having a front face and a back face;

(ii) at least one replaceable decorative element sized and adapted for removably insertion between the cover plate and the backing plate such that at least an exposed portion of the decorative element shows through the opening of the cover plate, each decorative element being no wider than the length of the elongated opening, and the decorative element having a front face and a back face; and (iii) means for removably affixing the backing plate to the cover plate so that the decorative element is firmly held in place therebetween;

the frame and the decorative element having interlocking engaging means for preventing the decorative element from moving along the length of the elongated opening; and (iv) means for removably attaching the plaque to a belt, wherein the attaching means comprise:

(A) backing screw nuts affixed to the back face of the backing plate; and (B) backing screws passing through the belt and threadingly engaging the backing screw nuts on the backing plate, the backing screws each having a head too large to pass through the belt and therefore capable of holding the belt firmly against the backing plate;

(b) selecting a belt;

(c) assembling the kit of parts into a decorative plaque by placing the decorative element between the cover plate and the backing plate with the engaging means on the decorative element and the frame interlocking, and then using the affixing means to affix the backing plate to cover plate so that the decorative element is firmly held therebetween; and (d) using the attaching means to attach the decorative plaque to the belt by the steps of:

(i) punching holes in the belt at positions corresponding to the backing screw nuts on the back face of the backing plate, each hole sized such that it allows passage of a backing screw but not the head of the backing screw, and then (ii) passing the backing screws through the holes in the belt, and tightening the backing screws against the backing screw nuts on the backing plate so as to hold the belt firmly against the backing plate.

* * * * *